US005854455A

United States Patent [19]

Cranick et al.

[11] Patent Number: 5,854,455

[45] Date of Patent: Dec. 29, 1998

[54] SWITCHING DEVICE WITH SECONDARY SWITCHING FUNCTION

[75] Inventors: John Cranick, White Lake; Mark Feldman, Farmington Hills, both of Mich.

[73] Assignee: UT Automotive Dearborn, Inc., Dearborn, Mich.

[21] Appl. No.: 824,005

[22] Filed: Mar. 25, 1997

[51] Int. Cl.[6] ..... H01H 9/00

[52] U.S. Cl. ..... 200/1 B; 200/6 R; 200/406

[58] Field of Search ..... 200/1 R, 1 B, 200/1 V, 5 R, 5 A, 6 R, 11 K, 6 A, 512–517, 550–553, 292–237, 406, 535

[56] References Cited

U.S. PATENT DOCUMENTS 4,117,286 9/1978 Methner et al. ..... 200/237 X
4,376,237 3/1983 Long ..... 200/4 X
4,803,316 2/1989 Hayashi et al. ..... 2000/406
5,571,998 11/1996 Momoi ..... 200/50.28

*Primary Examiner*—J. R. Scott
*Attorney, Agent, or Firm*—Howard & Howard

[57] ABSTRACT

A switching device includes the ability to perform a primary and secondary switching function through the use of a single switch handle. A primary switch contact is activated when the switch handle is moved in a desired direction. A secondary switch contact is activated when the switch handle is further moved in the same direction. The secondary switch contact includes a generally flexible conductive member supported adjacent a printed circuit board. An actuator portion of the switch handle moves into contact with the generally flexible conductive member causing a central portion of that member to flex toward and contact the printed circuit board. Such electrical contact results in a signal being generated that is indicative of a desire to accomplish the secondary switching function.

18 Claims, 3 Drawing Sheets

SWITCHING DEVICE WITH SECONDARY SWITCHING FUNCTION

BACKGROUND OF THE INVENTION

This invention generally relates to switching devices and, more particularly, to a switching device including a strategically designed and placed switch contact for accomplishing a secondary switching function.

A variety of switching controls are used to accomplish various tasks. In some instances, it is desirable to provide a single switch assembly that can accomplish a primary switching function and a secondary switching function. One example of such a situation is within a vehicle having a power window adjustment feature.

In some vehicles, the switch assembly for lowering or raising a window allows the user to choose one of two modes of lowering the window. First, the window can be lowered so long as the user is manipulating the switch in a particular direction. A second mode of lowering the window is sometimes referred to as an "automatic" mode. This is typically accomplished by the user moving the appropriate switch to its furthest extreme in the proper direction. If the user holds the switch in that position for a preselected minimum amount of time, an electronic controller associated with the vehicle determines that the user desires the window to be lowered in the automatic mode. Once the electronic controller instigates the automatic mode, the user can remove their finger from the switch and the window is continually lowered until it reaches its lowest position.

Providing such a feature within a vehicle is desirable. Providing such a feature is not without problems, however. For example, additional componentry and redesign work is often required to make an existing switch assembly suitable for such a function. Further, different operation profiles may be desired or required for different applications and, current systems require substantial re-work for such customization.

Therefore, it is desirable to provide an improved switching device that permits a user to readily accomplish a primary and secondary switching function. Further, it is desirable to have such a switching device that is readily and easily adapted to a variety of customized requirements for different applications. This invention meets those needs in a way that has not been accomplished in prior attempts.

SUMMARY OF THE INVENTION

In general terms, this invention is a switching device having a unique arrangement for accomplishing a secondary switching function. A switching device designed according to this invention includes several basic features. A first switch contact is positioned so that it can be selectively coupled to a power supply. A second switch contact includes a generally flexible conductive member. A signal generator is provided to generate a signal indicating that a secondary switching function should be performed. The second switch contact is positioned adjacent the signal generator such that a central portion of the flexible conductive member is movable between a position where it does not contact the signal generator and a second position where it does contact the signal generator.

A switch handle is provided that can be manipulated by a user of the switching device. The switch handle includes a first actuator portion that engages the first switch contact so that the first switch contact is coupled with the power supply to accomplish a primary switching function. This occurs when the switch handle is moved in an appropriate direction.

The switch handle also includes a second actuator portion that engages the second switch contact to cause the central portion of the flexible member to flex and contact the signal generator, which accomplishes a secondary switching function. The second actuator portion engages the flexible member of the second switch contact when the switch handle is moved in the same direction as it was moved to accomplish the primary switching function although it is moved a further distance.

In the presently preferred embodiment of this invention, the generally flexible conductive member of the second switch contact is dome-shaped. The signal generator preferably is a printed circuit board. The dome-shaped flexible conductive member includes extensions that extend outwardly from the central portion of the dome. These central portions preferably are held in contact against the printed circuit board by a plastic retainer piece. The central portion or apex of the dome normally does not contact the printed circuit board. When the switch handle is moved in the proper direction for a sufficient distance, the second actuator portion engages the central portion of the dome and flexes it into contact with the printed circuit board. Once electrical contact is made between the central portion of the flexible member and the printed circuit board, the signal generator generates a signal that indicates that the secondary switching function should be performed.

These and other features and advantages of this invention will become more apparent to those skilled in the art from the following detailed description of the presently preferred embodiment. The drawings that accompany the detailed description can be described as follows.

DETAILED DESCRIPTION OF THE PREFERRED EMBODIMENT

The following describes a switching device designed according to this invention that is used in a particular application. Specifically, reference will be made to the use of such a switching device for purposes of controlling a power window feature within a vehicle. This invention is not limited, however, to power window applications only. It will become apparent to those skilled in the art that the novel features of this invention will have a variety of applications.

Figure 1:
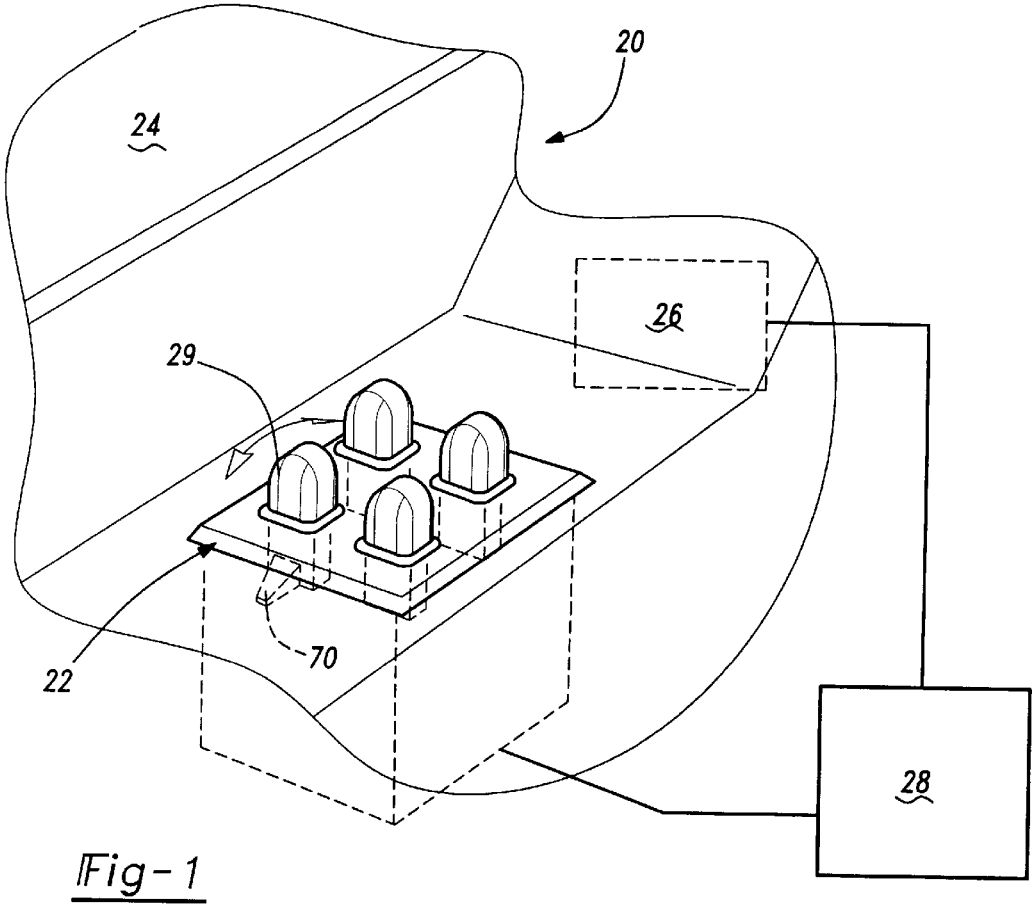
FIG. 1 is a diagrammatic illustration of a switching assembly designed according to this invention as it would be mounted within a vehicle.

FIG. 1 diagrammatically illustrates a portion of a car door 20. A switching device 22 is mounted on the door 20. The switching device 22 enables a driver or passenger within the vehicle to control the position of the windows on the vehicle. An example window 24 is illustrated. The power window assembly includes a motor 26 and an electronic controller 28. The electronic controller 28 interfaces between the switching device 22 and the motor 26 so that the motor 26 accomplishes the desires of the driver of the vehicle, for example.

Figure 2:
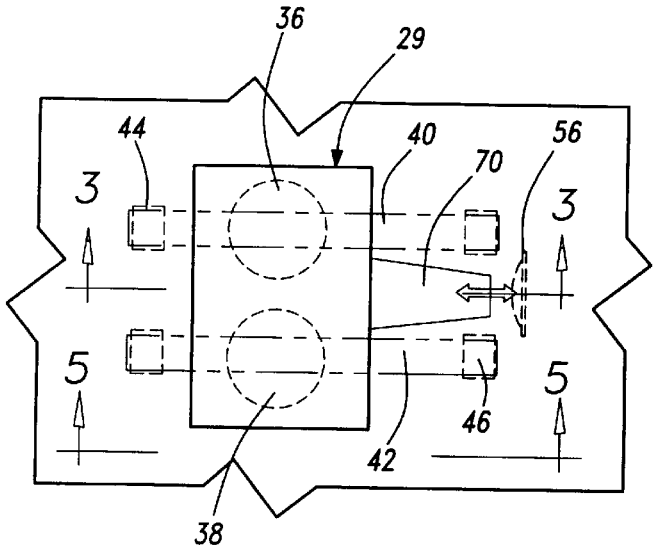
FIG. 2 is a top elevational illustration of selected components of the switching assembly of FIG. 1.
Figure 3:
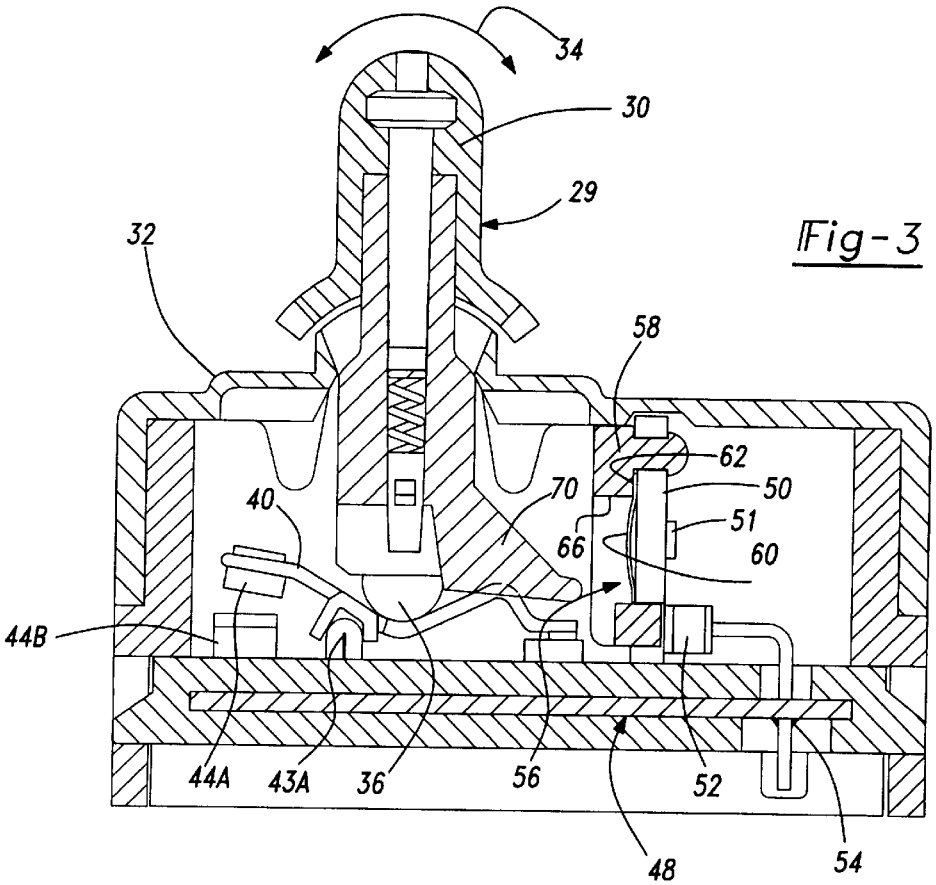
FIG. 3 is a partial cross-sectional illustration taken along the lines 3—3 from FIG. 2.

FIGS. 2 and 3 show a selected switch 29 of the switching device 22 in more detail. A switch handle 30 is pivotally supported within a housing 32 so that the switch handle can be manipulated in a fore and aft direction as schematically illustrated by the arrow 34. For purposes of illustration, the switch handle is moved to the left to lower a window and to the right (according to the drawing) to raise a window.

The switch handle 30 includes two plungers 36 and 38. These plungers serve as actuator portions for actuating primary switch contacts 40 and 42, which pivot about pivot supports 43A and 43B, respectively. The switch contact 40 includes a normally open switch contact 44A at one end and a second end 45. The contact 44A completes a circuit when in contact with the fixed contact member 44B. The T switch contact 42 includes a normally open switch contact 46A at one end and a second end 47. The contact 46A completes a circuit when in contact with the fixed contact member 46B. These fixed contact members 44B and 46B are coupled to a circuit plate 48, which serves as a power supply for the switching device 22. The switch contacts 40 and 42 are referred to as primary switch contacts because when they are actuated, the resulting action, as controlled by the controller 28, is considered the primary switching function. In the embodiment under consideration, the primary switching function would be to raise or lower a window so long as the user manipulates the switch handle 30 so that the switch contact end 46 or 44 is closed, respectively.

Figure 5:
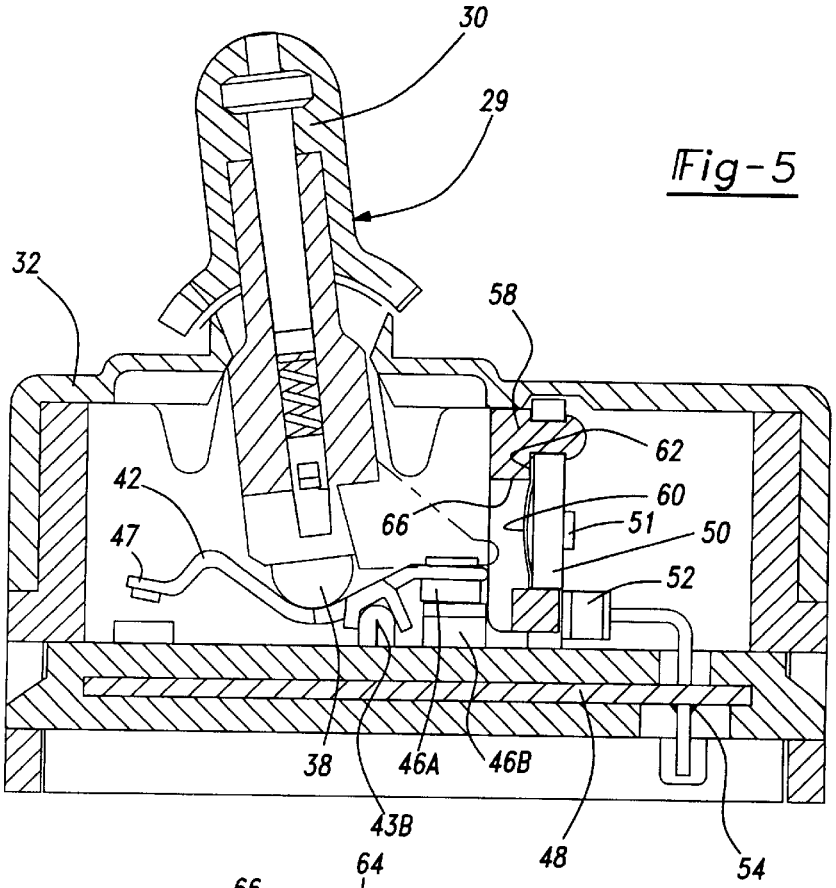
FIG. 5 is a partial cross-sectional illustration taken along the lines 5—5 from FIG. 2.

For example, when the switch handle 30 is pivoted to the left (according to FIG. 5) relative to the exterior of the housing 32, the plunger 38 moves along a portion of the surface of the primary switch contact 42. Such movement of the plunger 38 causes the switch contact end 46 to be closed, which completes an appropriate circuit within the circuit plate 48 indicating to the electronic controller 28 that the window should be lowered from its current position. So long as the user holds the switch handle 30 in the position shown in FIG. 5, the plunger 38 keeps the normally open switch contact end 46 in a closed position and the electronic controller 28 continues to cause the motor 26 to lower the window.

In a similar fashion, when the switch handle 30 is pivoted to the right (according to the drawing) the window will be raised. Given this description, those skilled in the art will be able to realize a suitable circuit plate, motor and controller design and, therefore, further details regarding those components need not be given here.

Figure 4:
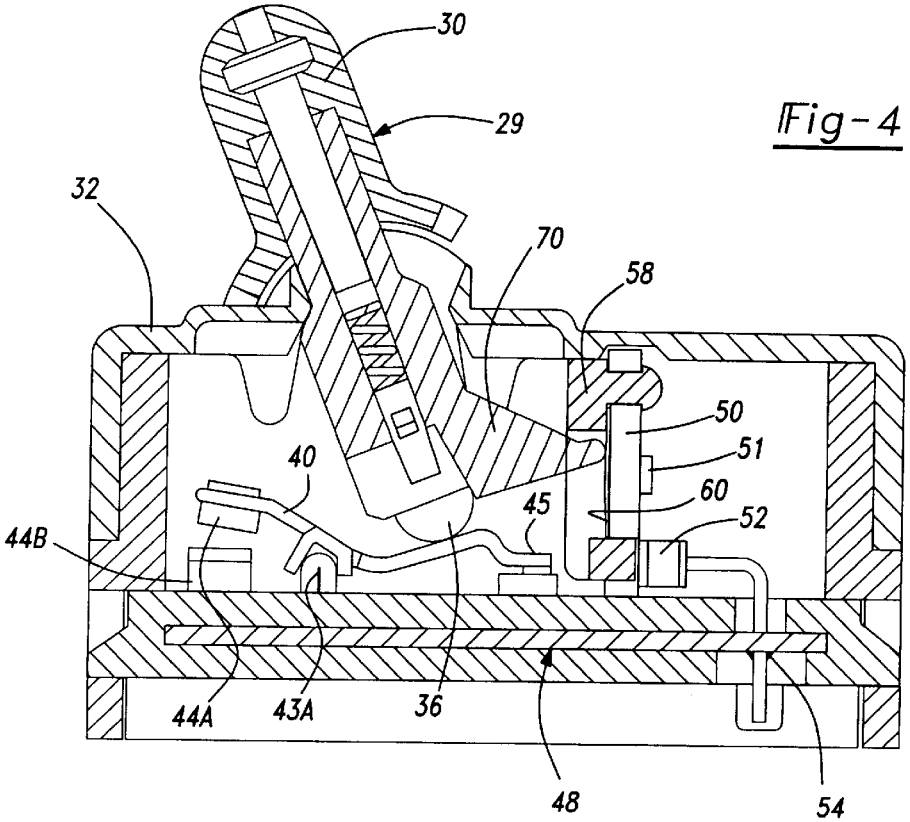
FIG. 4 shows the embodiment of FIG. 3 in another position.
Figure 6:
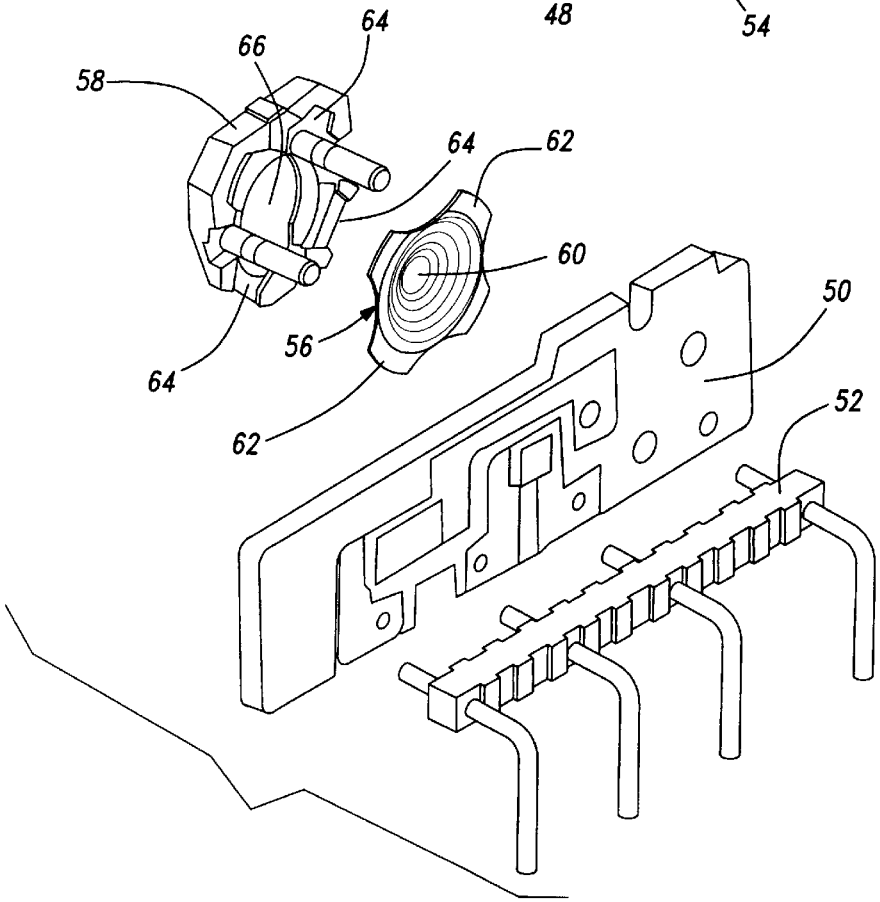
FIG. 6 is a diagrammatic, exploded view of a preferred secondary switch contact designed according to this invention.

Referring to FIGS. 3, 4 and 6, the switch device 22 further includes a printed circuit board assembly 50 having a conductive contact portion 51. A header 52 facilitates mounting the printed circuit board 50 in a perpendicular orientation relative to the circuit plate 48. The printed circuit board 50 can be supported by the header 52 alone, or in combination with an interface between the printed circuit board 50 and other parts of the housing 32. The header 52 facilitates an electrical connection between the printed circuit board 50 and the circuit plate 48. In the presently preferred embodiment, a soldered connection 54 is provided between the printed circuit board 50 and the circuit plate 48.

A generally flexible conductive member 56 is supported adjacent the printed circuit board 50 by a retainer element 58. In the preferred embodiment, the retainer element 58 is a piece of molded plastic. The generally flexible conductive member preferably is a dome-shaped piece of stainless steel. FIG. 6 illustrates the conductive member 56 in greater detail.

In the preferred embodiment, the flexible conductive member 56 includes a central portion 60 and a plurality of arms or extensions 62 that project outwardly from the central portion 60. The central portion 60 preferably has a convex surface on one side and a concave surface on an opposing side. The conductive member 56 is mounted or supported adjacent the printed circuit board 50 so that the concave side of the central portion faces the printed circuit board 50. The arms 62 preferably are received within slots 64 on the plastic retainer 58. The central portion 60 of the conductive member 56 preferably protrudes at least partially through an opening 66 through a central part of the retainer 58.

The switch handle 30 also includes an actuator portion 70 that is oriented toward the flexible conductive member 56. When the switch handle 30 is moved to the left (according to the drawings) a sufficient distance, the actuator 70 will come into contact with the central portion 60 of the flexible conductive member 56. A sufficient amount of force placed on the switch handle 30 will result in the actuator 70 causing the central portion 60 to flex toward the printed circuit board 50. Once the central portion 60 is flexed sufficiently to contact the conductive contact portion 51 that completes a circuit resulting in the printed circuit board 50 generating a signal that is communicated to the electronic controller 28. Given this description, those skilled in the art will be able to choose a conductive contact portion 51 design having a contact arrangement suitable for a particular application. This signal indicates to the controller 28 that the user desires to accomplish a secondary switching function. Specifically, in this embodiment, the signal generated by the printed circuit board 50 indicates that the user desires the window to be lowered in an automatic mode.

The perpendicular orientation of the printed circuit board 50 relative to the circuit plate 48 provides the further advantage of serving as a mechanical stop for movement of the switch handle 30. Moreover, varying the thickness of the flexible member 56 and/or the shape of the central portion 60 readily provides customized operation characteristics. For example, the movement of the switch handle 30 and the necessary effort required to accomplish the secondary switching function depends upon the shape and thickness of the flexible conductive member 56. Similarly, the physical placement of the circuit board 50 relative to the pivot point of the switch handle 30 controls the amount of movement required to accomplish a desired switching function.

A switching device designed according to this invention provides the further advantages of simplifying and reducing the number of pieces or components required to accomplish a primary and secondary switching function. The overall switching device is readily adaptable to a variety of applications and allows for a compact design.

The foregoing description is exemplary rather than limiting in nature. Variations and modifications to the disclosed embodiment may become apparent to those skilled in the art that do not necessarily depart from the purview and spirit of this invention. For example, as mentioned a switching device including the inventive features disclosed above can be used for a variety of applications that are not limited to controlling power windows within a vehicle. Accordingly, the scope of legal protection afforded this invention can only be determined by studying the following claims.

We claim:

1. A switching device, comprising:

a housing;

an electrical power supply supported in said housing;

a first switch contact supported in said housing to be selectively moved from a first position into a second position where said switch contact is coupled to said power supply;

a second switch contact supported within said housing including a flexible conductive member having a flexible contact surface;

a signal generator supported within said housing and having a conductive contact portion, said second switch contact being supported adjacent said signal generator such that a central portion of said flexible surface is deflected between a first position where said central portion does not contact said conductive contact portion and a second position where said central portion contacts said conductive contact portion; and a user manipulatable switch handle supported for movement relative to said housing and having a first actuator portion that only engages said first switch contact to thereby selectively move said first switch contact into said position to accomplish a primary switching function when said switch handle is moved a first distance in a first direction and a second actuator portion that only engages said second switch contact to thereby cause said central portion to contact said conductive contact portion to accomplish a secondary switching function when said switch handle is moved a second distance in said first direction, wherein said second distance is greater than said first distance.

2. The device of claim 1, wherein said flexible conductive member is a generally dome-shaped member.

3. The device of claim 2, wherein said flexible conductive member is made from stainless steel.

4. The device of claim 1, wherein said flexible surface central portion has a generally convex surface on one side of said member and a generally concave surface on a second side of said member wherein said second side faces said signal generator and wherein said conductive member includes a plurality of generally flat projections extending generally away from said central portion.

5. The device of claim 4, further comprising a non-conductive retainer member that supports said flexible conductive member adjacent said signal generator.

6. The device of claim 1, wherein said signal generator comprises a printed circuit board.

7. The device of claim 6, wherein said power supply has a generally planar portion oriented in a first plane and wherein said printed circuit board is generally planar and oriented in a second plane that is generally perpendicular to said first plane.

8. The device of claim 7, wherein said handle is supported for pivotal movement relative to said power supply and wherein said printed circuit board is positioned to limit an amount of movement of said handle in said first direction.

9. The device of claim 1, further comprising an electronic controller coupled to said power supply and said signal generator and wherein said signal generator generates a secondary signal that is responsively interpreted by said electronic controller to perform said secondary function.

10. A switching device, comprising:

a housing;

a power supply supported in said housing and having a generally planar portion oriented in a first plane;

a first switch contact pivotably supported within said housing to be selectively pivoted into an activate position wherein said first switch contact is coupled to said power supply;

a signal generator supported in said housing and coupled to said power supply and having a planar portion that is oriented in a second plane that is generally perpendicular to said first plane, said planar portion having a conductive contact portion;

a second switch contact supported adjacent said signal generator such that a central, generally flexible portion of said second switch contact is moveable between a first position where said central portion does not contact said conductive contact portion of said signal generator and a second position where said central portion contacts said conductive contact portion; and a user manipulatable switch handle supported for movement relative to said housing and having a first actuator portion that engaging said first switch contact to thereby selectively couple said first switch contact with said power supply to accomplish a primary switching function when said switch handle is moved a first distance in a predetermined direction and a second actuator portion that engages said second switch contact to thereby move said central portion into said second position to accomplish a secondary switching function when said switch handle is moved a second distance is said predetermined direction, wherein said second distance is greater than said first distance.

11. The device of claim 10, wherein said power supply comprises a circuit plate and said signal generator comprises a printed circuit board that is electrically coupled to said circuit plate.

12. The device of claim 10, wherein said second switch contact comprises a piece of conductive material that has a thickness, a length and a width and wherein said length and said width are substantially greater than said thickness.

13. The device of claim 12, wherein said second switch contact comprises a generally dome-shaped central portion with a generally concave surface facing toward a conductive portion of said signal generator and a plurality of arm portions extending outwardly from said central portion and further comprising a non-conductive retainer that engages at least some of said arm portions to support said second switch contact adjacent said signal generator.

14. A switching device for use in controlling a position of adjustable windows in a vehicle, comprising:

a housing;

a switch handle that is moveably supported by said housing and manipulatable in a first direction and in a second direction and including a first actuator member, a second actuator member and a third actuator member;

an electrical power supply supported within said housing;

a first switch contact supported within said housing to be selectively engaged by said first actuator member and coupled to said power supply when said switch handle is manipulated in said first direction to thereby cause a preselected window to be adjusted in a first direction in a first mode;

a second switch contact supported within said housing to be selectively engaged by said second actuator member and coupled to said power supply when said switch handle is manipulated in said direction to thereby cause the window to be adjusted in a second direction;

a signal generator supported within said housing and having a conductive contact portion; and a generally flexible conductive member that is supported within said housing and adjacent said signal generator such that a portion of said conductive member is engaged by said third actuator member and moveable between a first position where said portion of said conductive member does not contact said signal generator conductive contact portion and a second position where said portion of said conductive member contacts said signal generator conductive contact portion when said switch handle is moved in said first direction a preselected distance to thereby cause the window to be adjusted in the first direction in a second mode.

15. The device of claim 14, wherein said power supply comprises a circuit plate having a generally planar portion that is oriented in a first plane and said signal generator comprises a printed circuit board that is generally planar and oriented in a second plane that is generally perpendicular to said first plane.

16. The device of claim 14, wherein said generally flexible conductive member comprises a sheet of a generally flexible, electrically conductive material that has a central portion and a plurality of extensions extending generally away from said central portion and wherein said device further comprises a retainer member that engages at least some of said extensions and said signal generator to thereby maintain said flexible conductive member adjacent to said signal generator.

17. The device of claim 16, wherein said extensions are maintained in contact with said signal generator by said retainer member and wherein said central portion is generally dome shaped and an apex of said central portion is biased away from said signal generator.

18. The device of claim 17, wherein said generally flexible conductive member comprises stainless steel.

* * * * *